United States Patent [19]

Staats

[11] Patent Number: 4,672,919

[45] Date of Patent: Jun. 16, 1987

[54] DIRECT POWER VENTED WATER HEATER

[75] Inventor: Charles W. Staats, Yeadon, Pa.

[73] Assignee: Bradford-White Corporation, Philadelphia, Pa.

[21] Appl. No.: 742,605

[22] Filed: Jun. 7, 1985

[51] Int. Cl.[4] ..... F22B 5/00

[52] U.S. Cl. ..... 122/13 R; 122/17; 122/156; 122/162; 122/158

[58] Field of Search ..... 122/13 R, 14–19, 122/157, 156, 158, 168, 367 A

[56] References Cited

U.S. PATENT DOCUMENTS

| | | | |
|---|---|---|---|
| Re. 31,256 | 5/1983 | Schmidt | 126/307 A |
| 1,643,859 | 9/1927 | Sanvage . | |
| 1,707,281 | 4/1929 | Sauvage | 110/162 |
| 1,713,442 | 5/1929 | Motcovich | 110/162 |
| 1,826,748 | 10/1931 | Delamere | 110/162 |
| 1,829,334 | 10/1931 | Birtch | 122/14 |
| 1,859,745 | 5/1932 | Morley . | |
| 1,935,919 | 11/1933 | Ronstrom | 122/16 |
| 2,348,950 | 5/1944 | Anderson | 110/162 |
| 2,443,359 | 6/1948 | Newhouse | 122/17 |
| 2,563,817 | 8/1951 | Carson . | |
| 3,280,774 | 10/1966 | English . | |
| 3,492,972 | 2/1970 | McLaren | 122/17 |
| 3,601,099 | 8/1971 | Vaillant et al. | 122/494 |
| 3,759,230 | 9/1973 | Cooksley | 122/156 |
| 3,782,303 | 1/1974 | Pfister et al. | 110/162 |
| 4,102,632 | 7/1978 | Hastings | 432/3 |
| 4,204,832 | 5/1980 | Miller | 110/162 |
| 4,254,759 | 3/1981 | Schmidt | 126/307 A |
| 4,262,608 | 4/1982 | Jackson | 110/162 |
| 4,303,042 | 12/1981 | Sumiyoshi | 122/17 |
| 4,356,794 | 11/1982 | Bouman et al. | 122/158 |
| 4,357,909 | 11/1982 | Kagoshima | 122/183 |
| 4,424,792 | 1/1984 | Shimek et al. | 126/80 |
| 4,485,746 | 12/1984 | Erlandsson | 110/162 |
| 4,487,137 | 12/1984 | Horvat et al. | 110/160 |
| 4,531,509 | 7/1985 | Wilhelm, Jr. | 122/17 |

*Primary Examiner*—Henry C. Yuen

*Attorney, Agent, or Firm*—Austin R. Miller

[57] ABSTRACT

A water heater having an insulated water tank with a cold water inlet line, a hot water outlet line and a baffled flue pipe extending vertically through the tank is provided. The flue pipe extends from a combustion chamber housing a burner located beneath the tank, to a flue gas collection chamber positioned above the tank. The collection chamber is in fluid communication with a blower and a flue gas exhaust line for conveying the flue gases through the exhaust line to a direct through-the-wall vent. Control apparatus is provided for sensing the temperature of the water in the tank and controlling the amount of fuel supplied to the burner in response thereto. The control apparatus turns on the blower when fuel is being supplied to the burner and turns off the blower when no fuel is being supplied to the burner.

8 Claims, 9 Drawing Figures

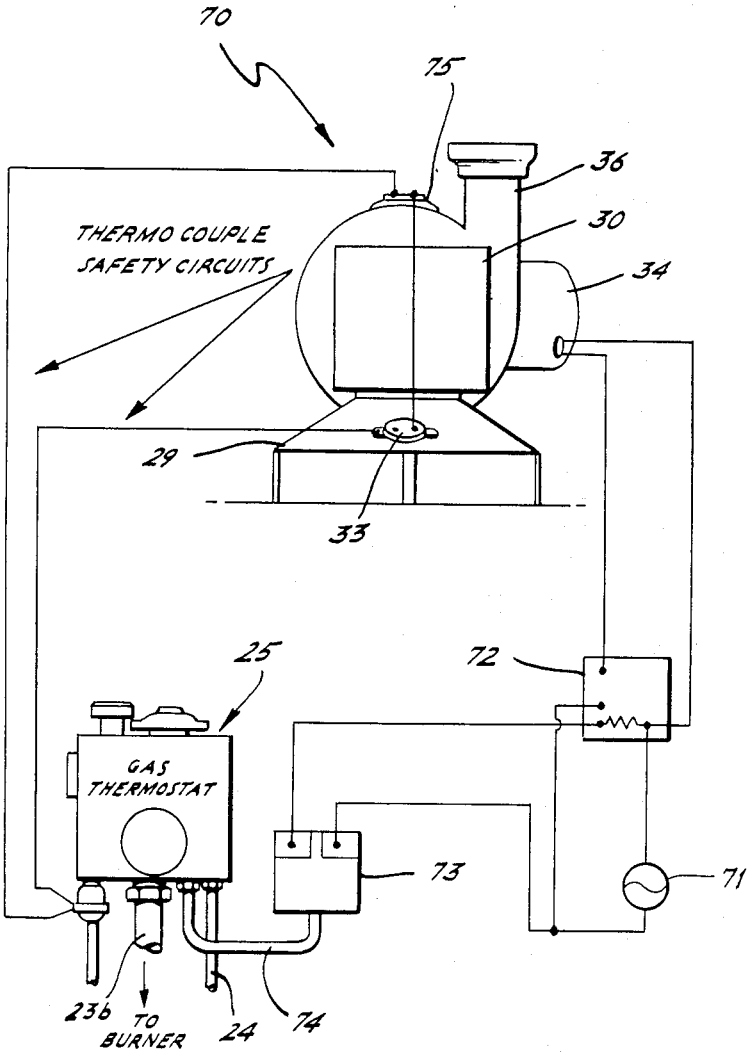
FIG. 7.
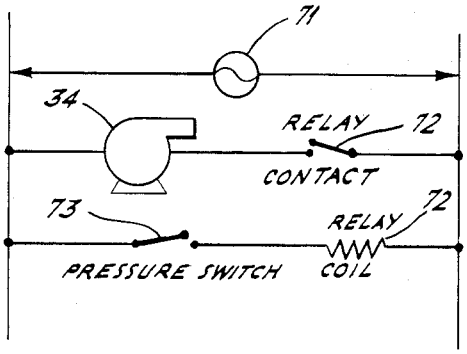
LADDER CIRCUIT DIAGRAM

DIRECT POWER VENTED WATER HEATER

BACKGROUND OF THE INVENTION

The present invention relates generally to a power-vented water heater. The power venting is provided by a blower which induces a draft for the flue gases generated by the water heater. The heater utilizes a direct through-the-wall vent design thereby obviating the need for a chimney. The heater also utilizes a flexible flue gas exhaust line providing the advantage of installation flexibility.

DESCRIPTION OF THE PRIOR ART

U.S. Pat. No. 4,262,608 to Jackson discloses a water heater having a draft hood and a flue pipe leading to an air manifold. This patent further discloses a blower positioned immediately downstream from the manifold. The blower has a dual function, namely to force the exhaust gases out through the exhaust pipe and simultaneously bring in fresh outside air through an intake pipe. This type of system is generally referred to as a "balanced flue" system.

U.S. Pat. No. 4,424,792 to Shimek et al discloses a wood burning furnace utilizing a direct vent design. The direct vent utilizes an induced draft blower installed on the exterior of the wall which operates to draw flue gases through the flue pipe. This patent further discloses a pivoting cap at the vent outlet.

U.S. Pat. No. 4,424,792 is directed primarily to a device for cooling the hot flue gases before they pass through the exterior wall by mixing them with cool outside air just before venting.

Other prior art patents include U.S. Pat. Nos. 3,601,099; 1,859,745; 3,759,230; 2,563,817; 4,357,909; 1,935,919; 1,643,859; 1,713,442; 1,826,748; 2,348,950; 3,280,774; 4,303,042; 3,492,972; 4,487,137; Re 31,256; 4,254,759; 3,782,303.

The water heaters of the prior art have typically relied upon the natural draft of the hot flue gases, rising through the flue pipe(s) of a water heater and being vented into a chimney. Because these gases were warmer than the surrounding air, they tended to r:aturally rise. However, with this type of design, the positioning of the water tank was somewhat limited since for practical reasons it had to be placed close to the chimney. Thus, it is an object of the present invention to provide a water heater which need not be vented into a chimney, thereby providing greater installation flexibility.

It is another object of the present invention to provide a water heater venting design which needs no chimney. This is important from several cost reduction standpoints. First, in new house construction, homes may be constructed without a chimney, thereby significantly lowering the cost of a new home. Secondly, during the so called "gas moratorium" of the 1950's and 1960's, many houses were built for all-electric heating, and therefore have no chimney. Now that natural gas has become comparatively much less expensive, there is a desire by many "all-electric" home owners to convert to natural gas heating. Thus, it is an important object of the present invention to provide a water heater flue gas venting design adaptable to conversions from all electric heating.

It is a further object of the present invention to provide a direct through-the-wall vent design adaptable to high velocity outside winds.

It is another important object of the present invention to provide a flexible connector pipe between the water heater and the direct vent which is air tight, flexible, and which operates at a lower temperature thereby reducing the risk of burn injuries, and obviating condensation problems.

These and other important objects of the present invention will become readily apparent from the description appearing hereinafter.

SUMMARY OF THE INVENTION

A direct power vented water heater having a collection chamber positioned above the water tank, the collection chamber being in fluid communication with an exhaust blower and a flue gas exhaust line, is provided. The blower conveys the flue gases through the exhaust line to a direct through-the-wall vent. Water heater control means are provided for sensing the temperature of the water in the tank and controlling the amount of fuel supplied to the burner in response thereto. The control means activates the exhaust blower when the fuel is being supplied to the burner but deactivates the exhaust blower when the fuel supply to the burner is cut. The control means also interrupts the supply of fuel to the burner in the event that either a total or partial blockage of the flue gas exhaust occurs.

BRIEF DESCRIPTION OF THE DRAWINGS

FIG. 7 comprises two schematic wiring diagrams of one embodiment of the burner and blower control apparatus utilized in the present invention.

Figure 1:
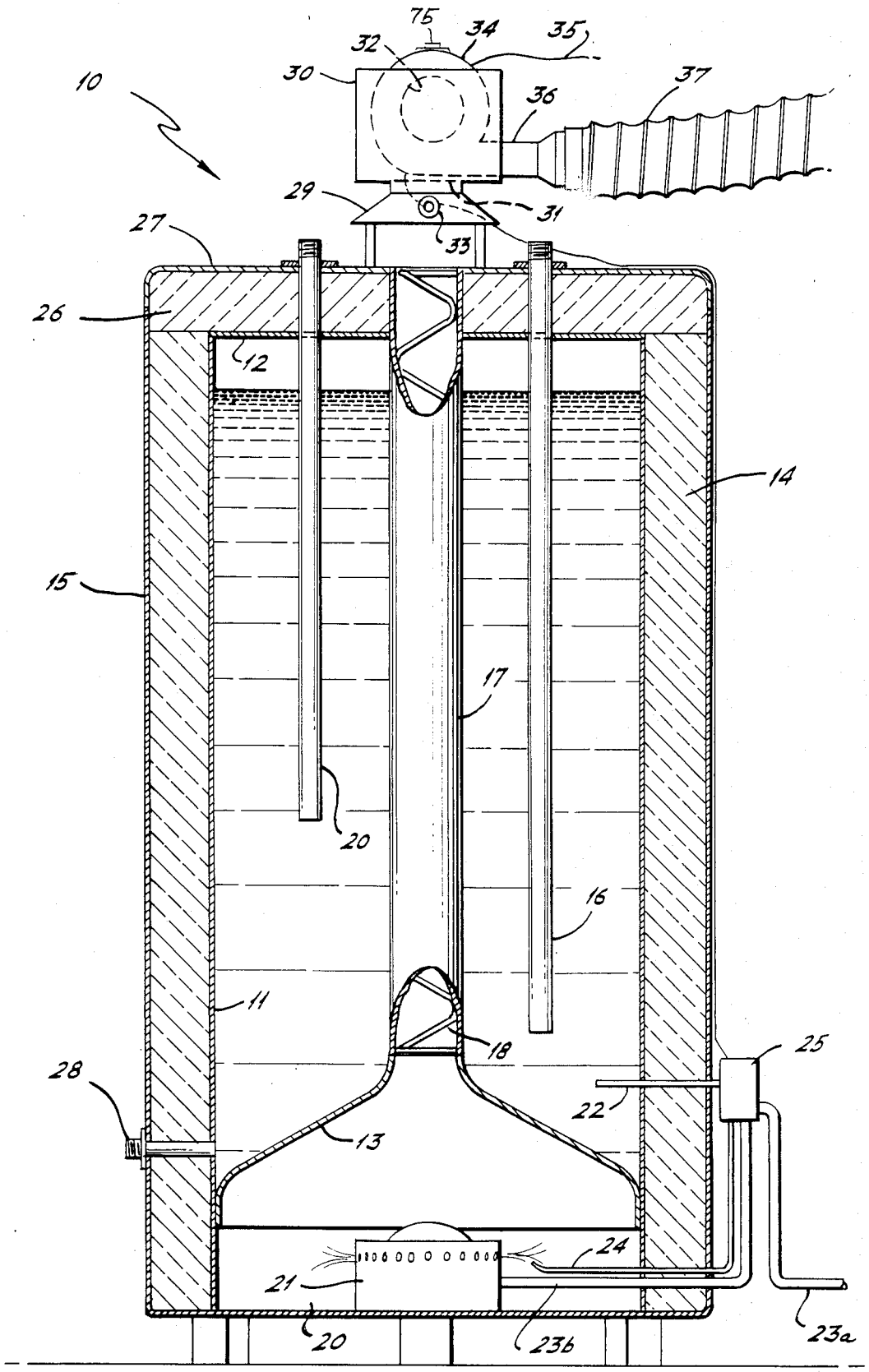
FIG. 1 is a side view, shown partly in section, of a water heater illustrating one embodiment of the present invention.

Although specific forms of apparatus embodying the invention have been selected for illustration in the drawings, and although specific terminology will be resorted to in describing those forms in the specification which follows, their use is not intended to define or to limit the scope of the invention, which is defined in the appended claims.

DESCRIPTION OF THE PREFERRED EMBODIMENTS

Referring to the drawings wherein like reference numerals refer to the same features in the several drawings, and especially referring to FIG. 1, there is shown a water heater 10. Heater 10 comprises a water tank 11 having a tank head 12 and a tank bottom 13. Extending vertically between tank head 12 and bottom 13 and passing through the interior of tank 11 is flue pipe 17 having internal baffling 18.

Figure 9:
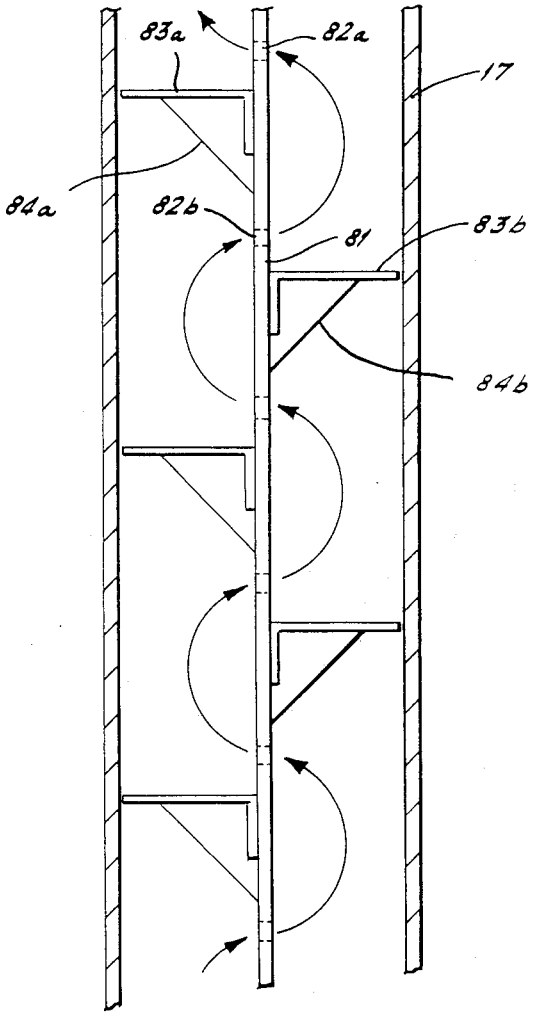
FIG. 9 is a side view, shown partly in section, of a removable flue pipe baffle which may be used in certain embodiments of the present invention.

An alternate baffle construction which may be utilized in the embodiment of water heater 10 illustrated in FIG. 1 is shown in FIG. 9. In this alternate embodiment, the baffle comprises a divider 81 having a length corresponding to the length of flue pipe 17 and a width which is substantially the same as the inner diameter of flue pipe 17. Thus, when the baffle is placed within flue pipe 17, divider 81 divides the interior of flue pipe 17 into two sections. Attached to divider 81 are a plurality of plates 83 having an L-shaped cross section and having a semicircular shape so that the outer edge of plate 83 is in substantially continuous contact with the inner surface of flue pipe 17. Each of the plates 83 is fixedly attached to divider 81 and rests against a triangular shaped support 84. Divider 81 is provided with a plurality of openings 82 between adjacent plates 83. All of divider 81, plates 83 and supports 84 are typically constructed of sheet metal. The baffle is simply placed within flue pipe 17 by inserting in an upward direction. The bottom sides of plates 83 are preferably not fixedly attached to the top sides of supports 84. In this way, the baffle can be easily removed from flue pipe 17 for cleaning purposes simply by pulling out divider 81 in a downward direction. When the baffle is in place within flue pipe 17, the flue gases passing upwardly within pipe 17 will follow the twisted path as shown by the arrows in FIG. 9.

Surrounding the side walls of tank 11 is an insulating layer 14 typically composed of fiberglass or polyurethane foam. Surrounding insulation layer 14 is outer jacket 15. Positioned beneath tank bottom 13 is combustion chamber 20 housing gas burner 21, a pilot line 24 and gas supply line 23. A gas valve and a thermocouple circuit (not shown) is provided within control means 25 in a known manner. An emersion rod 22 is provided in order to measure the temperature of the water in the tank 11. A thermostat is provided within the control means 25, as will be described in more detail hereinafter, to regulate the operation of the burner 21.

Positioned above tank head 12 is an insulating layer 26 and a jacket top 27. Draft diverter 29 is positioned above jacket top 27 and centered over, but spaced apart from, the top end of flue pipe 17. Diverter 29 is connected to collector box 30 at opening 31. Collector box 30 is a container typically constructed of sheet metal. Thus, diverter 29 connects with opening 31 to direct the flue gases rising from flue pipe 17 into collector box 30.

Blower 34 is connected to collector box 30 through opening 32. When activated, blower 34 draws the gases within collector box 30 through opening 32 and blows them through the blower outlet 36 into flexible conduit 37. Blower 34 is typically an electric powered blower having a power cord 35.

Provided on the draft hood 29 is a thermostat 33 which is operatively connected to the blower 34 by means of the control means 25. In the event that there is a blockage in the flue gas exhaust line downstream from the draft hood 29, the rising flue gases will spill out from under the draft hood and be sensed by thermostat 33. Thermostat 33 is typically set to signal control means 25 in the event the sensed temperature rises above about 180° F. Thermostat 33, sensing the spillage of the hot flue gases from underneath the draft hood 29, will activate control means 25 to shut off the supply of fuel to burner 21. In addition, thermostat 33 will also deactivate blower 34 at this time.

Also provided within the shroud of blower 34 is a second thermostat 75 which is also typically set to signal control means 25 in the event that the temperature rises above about 180° F. This dual (i.e. thermostats 33 and 75) safety circuit system is especially preferred from an operating standpoint. In the event that there is either a total blockage of the flue gas exhaust, or if the blower 34 fails to operate, thermostat 33 quickly senses the hot flue gases spilling out from under diverter 29 and quickly signals control means 25 to cut off the supply of gas to burner 21. In the alternative, in the event of only a partial blockage of the flue gas exhaust line, thermostat 75 is the first to sense the rising flue gas temperature and quickly signals control means 25 to cut off the supply of gas to burner 21.

Figure 6:
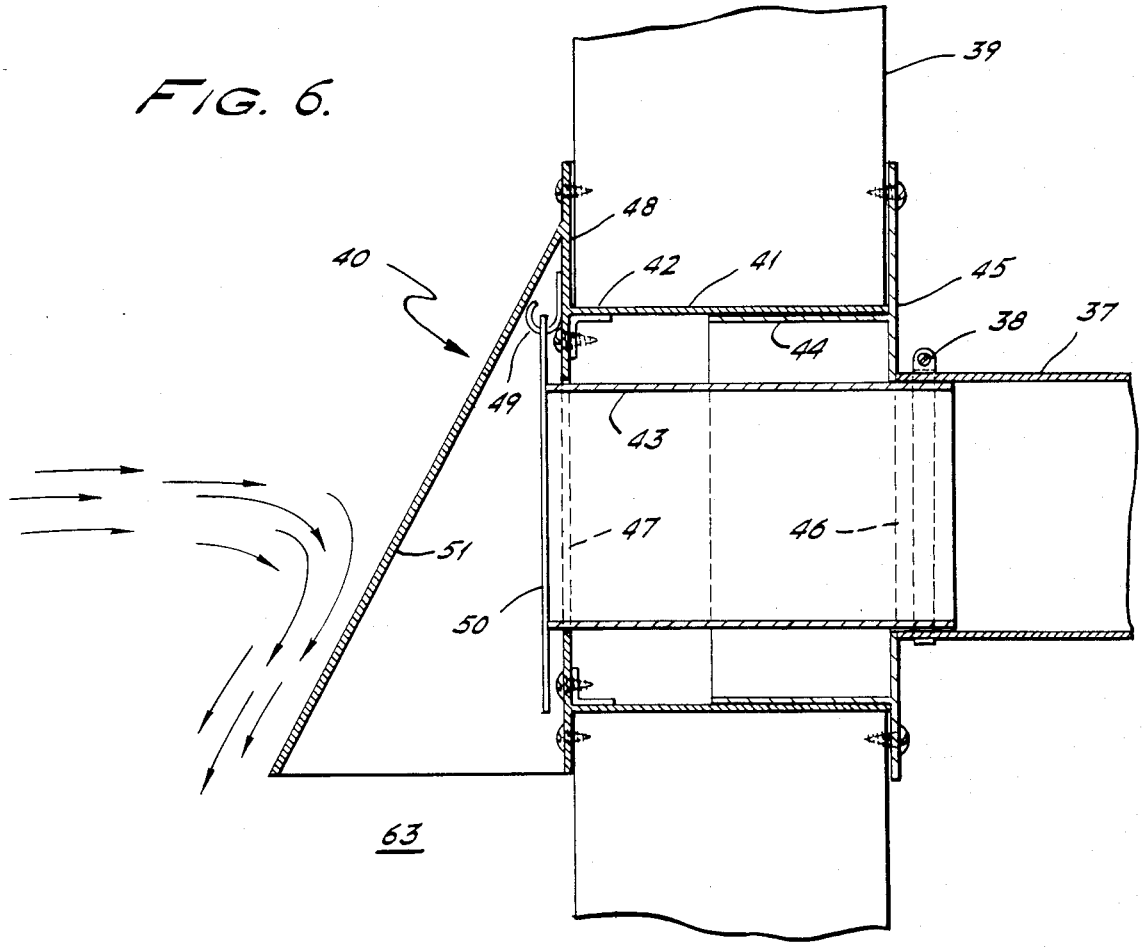
FIG. 6 is a side sectional view of a direct through-the-wall vent according to one embodiment of the present invention.

Turning now to FIG. 6 of the drawings, there is shown an embodiment of a direct through :-the-wall vent which is connected to the downstream end of flexible pipe 37. The term "through-the-wall" encompasses direct vents of the type which convey flue gases from an interior portion of a building or structure to an exterior portion of a building or structure for venting. Thus, for example, the term "through-the-wall" encompasses walls of all types, regardless of structure or composition, as well as other structures such as roofs and ceilings, as long as one side of the structure faces an interior space and the other side of the structure faces an exterior space into which the flue gases will be vented. In FIG. 6 there is shown a typical through the wall vent 40 mounted within a cylindrical hole 41 passing through wall 39. Within hole 41 is positioned a metal sleeve 42. An inner sleeve 44 having a face plate 45 is slid into the interior end of sleeve 42. Furthermore, face plate 45 has a circular hole 46 therein through which extends the interior end of conduit 43. Similarly, sleeve 42 has an exterior face plate 48 with a circular hole 47 through which the exterior end of conduit 43 extends. In this way, conduit 43 is annularly spaced within sleeve 42. Face plates 45, 48 are secured to the wall 39 by conventional means. Flexible pipe 37 is secured to the interior end of conduit 43 with a clamp 38.

Hingedly mounted on face plate 48 is flapper plate 50. A hinge 49 is provided for this purpose. Flapper plate 50 normally rests in a vertical position thereby acting as a damper when blower 34 is in an off cycle. However, when flue gases are flowing through flexible pipe 37 and conduit 43, the flapper plate 50 swings open to allow venting of the flue gases. A stationary plate 51 may also be provided in order to provide better protection against back flow in the conduit 43 and flexible conduit 37 in the event of high winds and the like. In the event that winds are blowing against the stationary plate 51 as indicated by the arrows, the flow of air is directed downwardly upon striking the angled plate 51. This downward flow of air causes a low pressure region 63 to form just below plate 51. This low pressure region 63 helps to draw the flue gases out of the space behind plate 51. Thus, stationary plate 51 assures proper ventilation of the flue gases even in the case of high velocity winds directed into the vent 40.

Flexible pipe 37 is preferably constructed from a wire reinforced EPDM (ethylene propylene diene monomer) rubber, which is airtight and both bendable and extendable. Flexible pipe 37 preferably has a continuous operating temperature rating above 200° F., more preferably above 250° F. Although the length of the flexible pipe 37 is not limited to any particular range, in most applications a length within the range of 6–15 feet is sufficient.

Because draft diverter 29 is spaced apart from the top end of flue pipe 17, the suction created by blower 34 draws not only the hot flue gases into collector box 30 but also draws some of the surrounding room air under diverter 29 into collector box 30. Thus, the hot flue gases are "diluted" by mixture with the ambient air. After this dilution, the gases pumped through flexible tube 37 are typically in the range of about 150°–180° F. At such low temperatures, condensation problems within flexible pipe 37 are practically eliminated. In addition, there is a much less likelihood of burn injuries to persons coming into contact with flexible pipe 37 because of this temperature dilution.

Figure 2:
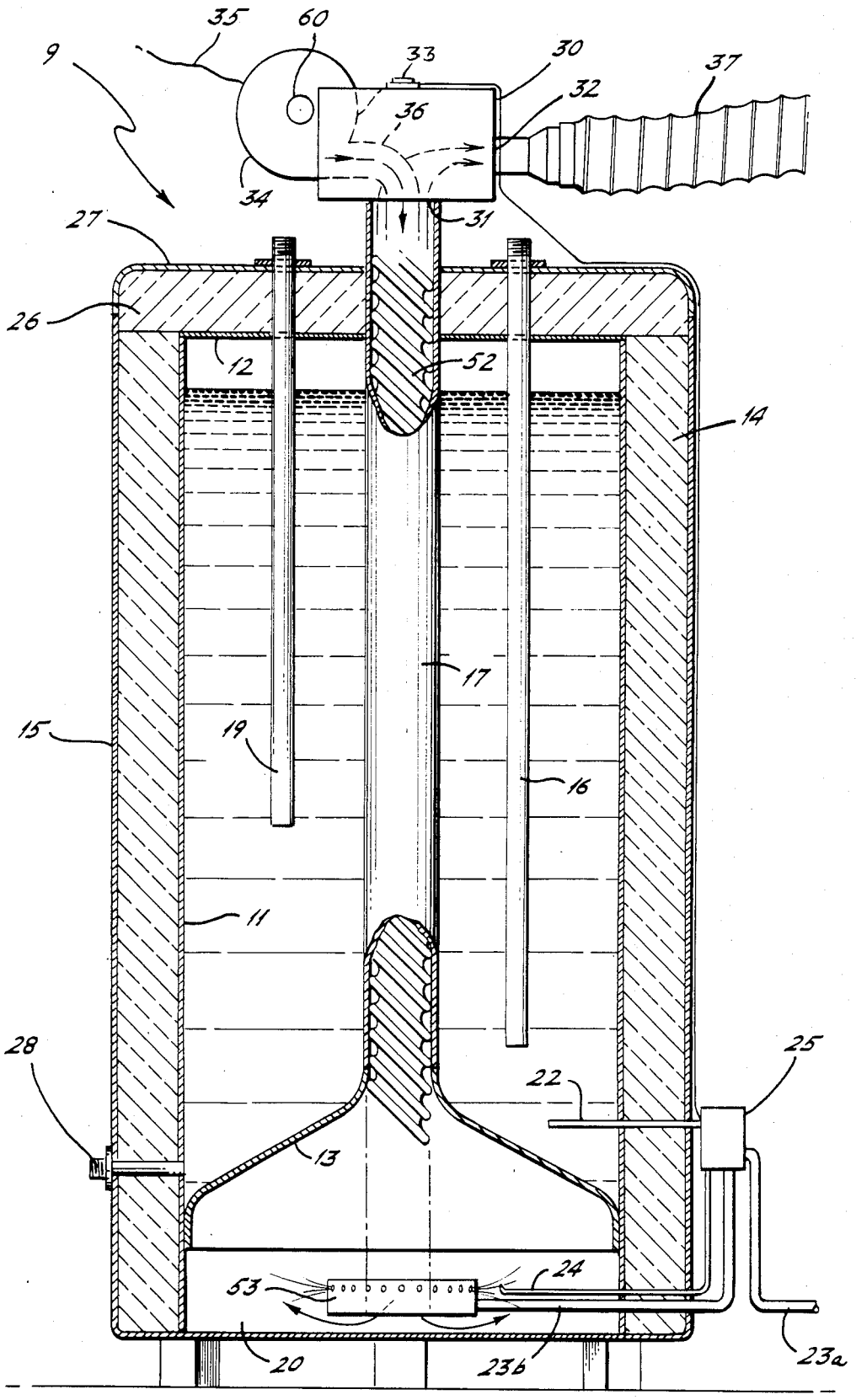
FIG. 2 is a side view, shown partly in section, of a water heater illustrating a second embodiment of the present invention.
Figure 4:
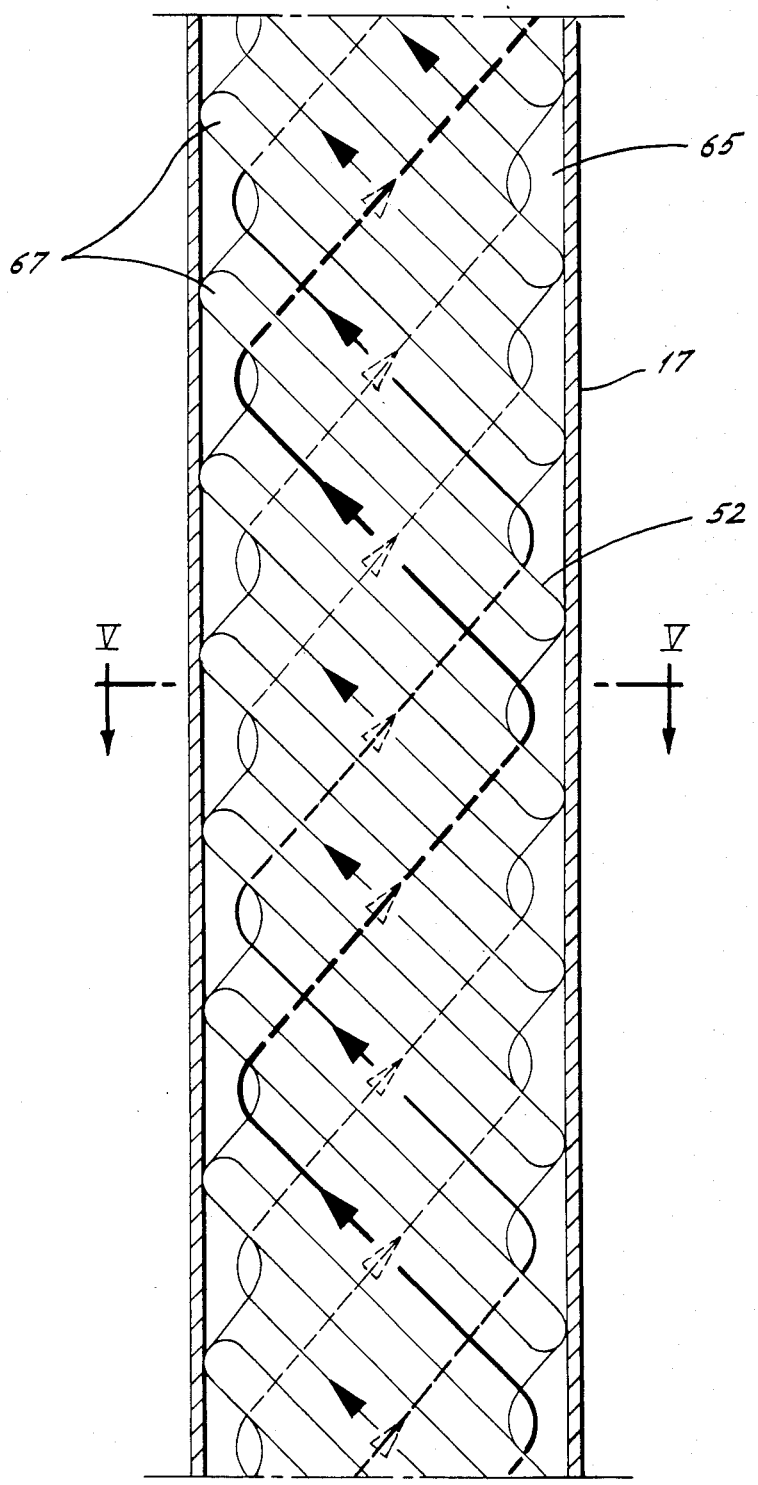
FIG. 4 is a side view, shown partly in section, of one baffled flue pipe design with may be utilized with certain embodiments of the present invention.
Figure 5:
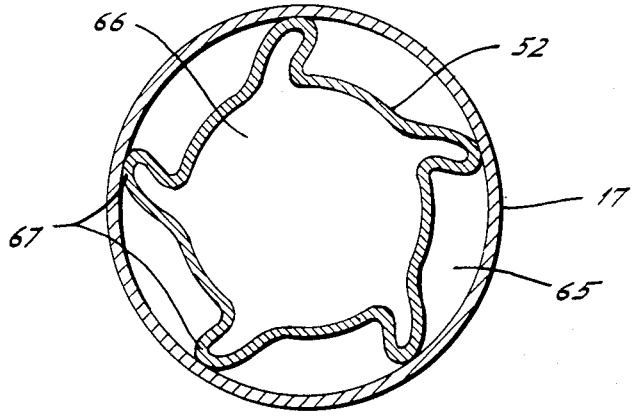
FIG. 5 is a sectional view of the baffled flue pipe illustrated in FIG. 4 taken along line V—V.

Referring now to FIGS. 2, 4 and 5, there is illustrated a second embodiment of the present invention wherein the blower 34 supplies combustion air to burner 53 while at the same time blowing the flue gases through flexible pipe 37 and out the direct vent 40. The heater 9 illustrated in FIG. 2 has a substantially airtight combustion chamber 20. Combustion air for burner 53 is provided by blower 34 and baffled tube 52. Blower outlet 36 is fluidly connected to the interior space 66 within baffled tube 52. When the blower is on, air is drawn from the space surrounding blower 34 and blown through the interior 66 of baffled tube 52. Baffled tube 52 extends into the lower portion of combustion chamber 20. Burner 53, having a "donut-shaped" configuration, wraps around the lower end of tube 52. Combustion air flows out the lower end of tube 52 as shown by the arrows and mixes with the fuel gas supplied to burner 53 allowing combustion to take place. Because chamber 20 is provided with appropriate seals to make it substantially airtight, the combustion flue gases are forced to flow upwardly within flue pipe 17 through the segmented exterior space 65.

The configuration of baffled tube 52 within flue pipe 17 is clearly illustrated in FIGS. 4 and 5. The baffled tube 52 is provided with a plurality of spiral ridges 67 along its circumference. Ridges 67 are in contact with the inside of flue pipe 17, thereby dividing the space 65 into a plurality of spiral pathways.

As the cool room air is forced through the interior space 66 it is prewarmed by countercurrent flow with the hot combustion flue gases passing upwardly through the segmented space 65. This allows for more efficient combustion of the fuel gases at burner 53.

At the top end of flue pipe 17, the exterior space 65 is open to the interior of collector box 30 through opening 31. Collector box 30 also has opening 32 connected to flexible pipe 37. In this way, the hot flue gases pass from space 65 into collector box 30 and finally into flexible pipe 37 whereby they flow out a direct vent 40.

Figure 8:
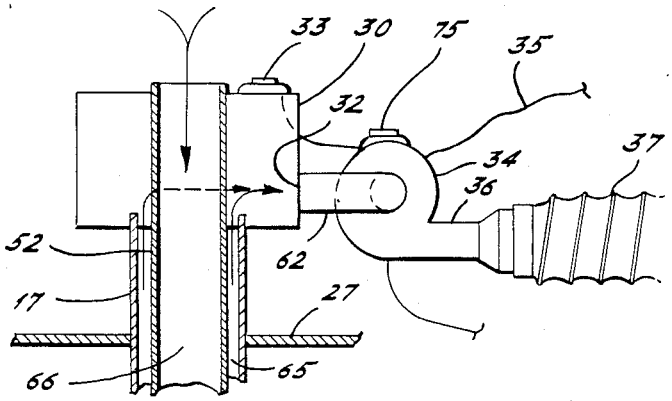
FIG. 8 is a side view, shown partly in section, of an alternate flue pipe, collector box and blower assembly which may be used in place of the assembly illustrated in FIG. 2.

FIG. 8 illustrates an alternate design of the collector box 30, flue pipe 17 and blower 34 which may be used with the heater 9 illustrated in FIG. 2. In this alternate design, blower 34 is positioned downstream from collector box 30 and blows the flue gases out the blower outlet 36 through flexible pipe 37. A pipe 62 is provided between opening 32 and blower 34. Thus, blower 34 provides suction to convey the flue gases from exterior space 65 into collector box 30, through pipe 62 and finally through blower 34 and flexible pipe 37. In this embodiment, tube 52 extends all the way through collector box 30 and opens at the top thereof. Because the combustion chamber 20 is airtight, the operation of blower 34 causes surrounding room air to be conveyed down the interior space 66 as shown by the arrows in order to provide combustion air to the burner 53.

Figure 3:
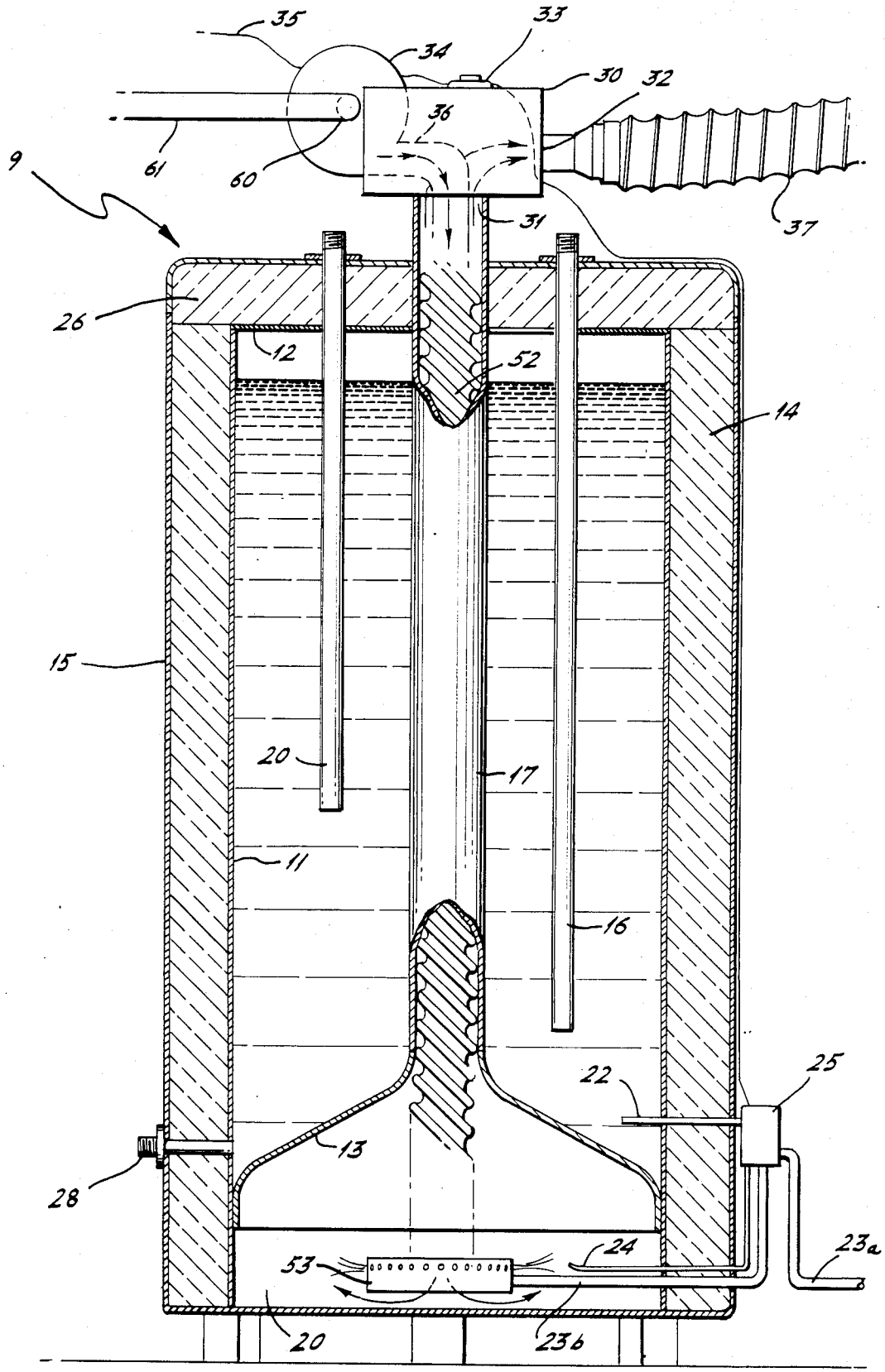
FIG. 3 is a side view, shown partly in section, of a water heater illustrating a third "balanced flue" embodiment of the present invention.

FIG. 3 illustrates a "balanced flue" version of the water heater 9 illustrated in FIG. 2. In the balanced flue design, blower 34 is provided with an air inlet pipe 61 which extends to a space outside the building. In this way, combustion air is drawn by blower 34 from the outside of the building through inlet pipe 61 and blown into the interior space 65. In this design, the water heater 9 is totally "closed" with respect to the room environment since the combustion air is drawn from outside the building and the flue gases are vented directly or:tside the building.

Referring to FIG. 7, there is illustrated schematically one embodiment of a blower and burner control circuitry which may be utilized with the present invention. There is illustrated a wiring diagram 70 as well as a ladder circuit diagram. Power is provided by a 115 power supply 71. A relay contact 72 is provided to control the supply of power to blower 34. Thermostat 75, within the shroud of blower 34, provides an advance sensing control in the event that there is a partial blockage in tb:e flow of flue gases downstream from blower outlet 36. Both thermostat 75 and thermostat 33 are operatively connected to control means 25 to shut off the flow of gas to the burner in the event of any blockage or restriction of the outward flow of flue gases through flexible pipe 37.

Control means 25 is operatively connected to a pressure switch 73 through a gas line 74. In the event that the thermostat within control means 25 calls for the burner to be activated, control means 25 opens a valve thereby causing gas to flow through gas supply line **23*b* as well as gas line 74. The flow of gas through line 74 causes pressure switch 73 to connect thereby supplying power to blower 34. This ensures that blower 34** will be operating when the burner is turned on.

Similarly, when the thermostat indicates that the temperature of the water within tank 11 has reached a desired level, control means 25 shuts off the supply of gas to gas supply line **23*b* and gas line 74. Thus, pressure switch 73 is disconnected and interrupts the supply of power to blower 34**.

Although this invention has been described in the specification with reference to specific forms thereof, it will be appreciated that a wide variety of equivalents may be substituted all without departing from the spirit and scope of the invention, which is defined in the appended claims.

I claim:

1. A through-the-wall water heater for installation in a building having a wall, without requiring the use of a chimney for exhaust gases, said heater having an insulated single piece water tank with a cold water inlet line, a hot water outlet line and a baffled flue pipe extending vertically through the tank, said flue pipe opening at its lower end upon a combustion chamber located beneath the tank, said combustion chamber containing a fuel burner, and said flue pipe opening at its other end upon a flue gas collection means whereby the flue gas travels upwardly toward the top of the tank and exits at the top, said collection means comprising a collection chamber positioned above the tank, said collection chamber being provided with a blower and having a draft hood between said flue pipe and said collection chamber, said collection chamber being in fluid communication through the wall of said building and being provided with a flue gas exhaust line for conveying the flue gases through the exchaust line to a direct through-the-wall vent having a conduit for conveying the flue gases from the flue gas exhaust line through the wall and having a stationary face plate which blocks direct access to the vent, control means connected to said burner and effective for sensing the temperature of the water in the tank and controlling the amount of fuel supplied to the burner in response thereto, the control means being connected to said blower to activate the blower and thereby exhaust the combustion flue gases through said wall of said building when fuel is being supplied to the bruner, and to deactivate the blower when no fuel is being supplied to the burner, said control means including means for sensing when the flue gas exhaust line is blocked and for interrupting the fuel supplied to the burner in response thereto.

2. The water heater as defined in claim 1, wherein the direct through-the-wall vent further comprises a hinged closure plate for blocking the conduit when no gases flow therethrough.

3. The water heater as defined in claim 1, wherein the flue gas exhaust line comprises a flexible conduit.

4. Apparatus as defined in claim 1 wherein said control means comprises a water temperature sensitive thermostat located on or in said tank, said water temperature sensitive thermostat actuating the supplying of fuel for said burner to maintain a desired set water temperature and automatically actuating the blower to push exhaust gas through said flue gas exhaust line and out through said vent at a controlled exhaust gas temperature, said controlled temperature being controlled by introducing atmospheric air into said draft hood for mixing with the flue gases, said controlled exhaust gas temperature preventing accidental human burn hazards at said through-the-wall vent and permitting flexible non-metallic material to be used in said flue gas exhaust line and keeping in suspension water vapor in the flue gas until said gas exits through the through-the-wall vent.

5. Apparatus as defined in claim 1 wherein said means for sensing when the flue gas exhaust line is blocked and for interrupting the fuel supplied to the burner comprises a pair of air temperature sensitive switches, one located on said draft hood and the other located on said blower, said air temperature sensitive switch located on said draft hood sensing exhaust gas temperatures upon total blockage of said flue gas exhaust line or upon non-actuation of said blower, said switch closing the fuel supply to the burner upon such blockage, said air temperature switch located on said blower sensing an increase in flue gas temperatures upon partial blockage of said flue gas exhaust line, said switch closing the fuel supply to said burner upon such blockage.

6. A through-the-wall water heater for installation in a building having a wall, without requiring the use of a chimney for exhaust gases, said heater having an insulated single piece water tank with a cold water inlet line, a hot water outlet line and a baffled flue pipe extending vertically through the tank, said flue pipe opening at its lower end upon a combustion chamber located beneath the tank, said combustion chamber containing a fuel burner, said combustion chamber being substantially air tight and having combustion air supply means to supply combustion air to the fuel burner, said combustion air supply means including a baffled tube positioned within said flue pipe and means to convey combustion air from an exterior space to the combustion chamber, said combustion chamber being in fluid communication through the wall of said building, said flue pipe opening at its other end upon a collection chamber above said tank, said collection chamber having a blower and a flue gas exhaust line extending therefrom for conveying the flue gases through the exhaust line to a direct through-the-wall vent having a conduit for conveying the flue gases from the flue gas exhaust line through the wall and having a stationary face plate which blocks direct access to the vent, control means connected to said burner and effective for sensing the temperature of the water in the tank and controlling the amount of fuel supplied to the burner in response thereto, the control means being connected to said blower to activate the blower and thereby exhaust the combustion flue gases through said wall of said building when fuel is being supplied to the burner, and to deactivate the blower when no fuel is being supplied to the burner said control means including means for sensing when the flue gas exhaust line is blocked and for interrupting the fuel supplied to the burner in response thereto.

7. The water heater as defined in claim 6, wherein the flue gas exhaust line comprises a flexible conduit.

8. The water heater as defined in claim 6, wherein the direct through-the-wall vent further comprises a hinged closure plate for blocking the conduit when no gases flow therethrough.

* * * * *